United States Patent [19]

Kishi et al.

[11] Patent Number: 5,001,815

[45] Date of Patent: Mar. 26, 1991

[54] COMBING CYLINDER UTILIZED FOR COMBING MACHINE

[75] Inventors: Katsutoshi Kishi, Gifu; Shigeyuki Tachi, Tsushima; Kazuhiro Inagaki, Kuwana, all of Japan

[73] Assignee: Howa Machinery, Ltd., Japan

[21] Appl. No.: 306,896

[22] Filed: Feb. 7, 1989

[30] Foreign Application Priority Data

Feb. 13, 1988 [JP] Japan ..... 63-31155

[51] Int. Cl.[5] ..... D01G 19/04; D01G 19/00

[52] U.S. Cl. ..... 19/234; 19/223; 19/233

[58] Field of Search ..... 19/223, 233, 234

[56] References Cited

U.S. PATENT DOCUMENTS

| | | | |
|---|---|---|---|
| 10,289 | 11/1853 | Heilmann | 19/223 |
| 822,479 | 6/1906 | Rooney | 19/234 |
| 1,316,376 | 9/1919 | Maynard et al. | 19/234 |
| 1,892,317 | 12/1932 | Nasmith | 19/234 |
| 3,585,706 | 6/1971 | Moriwaki | 29/423 |
| 3,922,757 | 12/1975 | Horiuchi | 19/234 |

FOREIGN PATENT DOCUMENTS

| | | | |
|---|---|---|---|
| 3336876 | 4/1985 | Fed. Rep. of Germany . | |
| 654599 | 2/1986 | Switzerland . | |
| 123141 | 2/1919 | United Kingdom . | |
| 623624 | 5/1949 | United Kingdom | 19/234 |

*Primary Examiner*—Werner H. Schroeder
*Assistant Examiner*—Michael A. Neas
*Attorney, Agent, or Firm*—Stevens, Davis, Miller & Mosher

[57] ABSTRACT

An improved combing cylinder utilized for a combing machine provided with a fringe control member having a chevron shaped cross section and a forwardly inclined surface sloped toward the cylindrical boss of the combing cylinder, with respect to the direction of rotation of the combing cylinder. The fringe control member is rigidly mounted on the combing cylinder at a position downstream of the needle segment of the combing cylinder, in a condition satisfying the timing whereby the tip line surface of the fringe control member closely faces the bottom detaching roller when the detaching rollers start to change their direction of rotation from a reverse rotation to a normal rotation. The radius of the forward end of the fringe control member is made smaller than the radius of a peripheral surface of the tip end of the combing needles of the needle segment, so that a recessed portion is formed adjacent to and behind the last alignment of combing needles of the needle segment.

8 Claims, 3 Drawing Sheets

RADIUS OF THE TOP LINE SURFACE OF THE FRINGE CONTROL MEMBER

COMBING CYLINDER UTILIZED FOR COMBING MACHINE

1. FIELD OF THE INVENTION

The present invention relates to a combing cylinder of a combing machine, more particularly, to a combing cylinder of a combing machine utilized for a cotton spinning process.

2. DESCRIPTION OF THE RELATED ART

As is well known, in a combing machine provided with a combing cylinder and a rotary brush, these elements are disposed in a suction box, a fiber lap is processed by a plurality of combing needles planted on a needle segment of the combing cylinder, so as to remove short fibers from the lap. The short fibers removed from the lap and retained by the combing needles are removed therefrom by the stripping action of the rotary brush, and the short fibers thus taken from the combing needles of the combing cylinder are carried to a suction roller by the action of a suction air stream created in the suction box. The suction air stream in the suction box flows mainly along an air stream passage formed around the circumference of the combing cylinder in a space between a cover portion located at a front side cover of the suction box and the cylinder, toward a direction of rotation of the cylinder, from the upper position to the lower position.

Air is introduced into an upper aperture of the suction box positioned behind the detaching rollers, at the upper position of the combing cylinder, by the action of the downward suction air stream, and when a cotton fleece is displaced rearward by a reverse rotation of the detaching rollers, the air stream introduces the rear end portion of the fleece into the air stream passage, along the surface of the bottom detaching roller. In the conventional combing cylinder, the space between the circumferential surface of the balance segment portion, which is a part of the combing cylinder, and the circumferential surface of the rotary brush, is made larger by making the diameter of the needle segment portion smaller than the diameter of the balance segment portion of the combing cylinder, by about 10 to 15 mm, so that an air stream applying a downward suction force is applied to at least a front edge portion of a fleece during a rearward displacement of this fleece by the reverse rotation of detaching rollers of the combing machine. If the above-mentioned balance segment having a half cylindrical shape has a small diameter as mentioned above, a space between a bottom surface of a cushion plate, which is moving forward, and the circumferential surface of the balance segment becomes too large, and thus the timing of forming the above-mentioned condition coincides with the timing at which a fringe, which has been combed by the combing needles of the combing cylinder, is transferred to the detaching rollers to connect with the rear end portion of the rearward displaced fleece. In the above-mentioned large space, when a nipper knife having a vertical shape is moved forward, air between the nipper knife and the detaching rollers, i.e., a part of the air in front of the nipper knife, is introduced rearward through a space between the bottom surface of the cushion plate and the circumferential surface of the balance segment. If the combing machine is driven at a high speed, the front edge portion of the fringe, wherein a plurality individual fibers are separately projected forward in a substantially straight condition, is turned downward by the above-mentioned rearward air stream so that the front edge portion of the fringe is bent into a J curve shape. In this condition, when the front edge portion of the fringe approaches the circumferential surface of a bottom detaching roller, since the front edge portion of the fringe is further affected by the downward suction of the air stream, the fiber alignment of this portion is further disarranged and turned further downward.

Accordingly, a correct and smooth overlapping connection between the rear end portion of the fleece, which is displaced rearward by the reverse rotation of the detaching rollers, and the front edge portion of the fringe, is not obtained, and in nearly all cases, when the combing cylinder is driven at a speed as high as 250 r.p.m., the connection is broken, and accordingly, the continuous spinning operation of the combing machine must be stopped. As one method of controlling the creation of a fringe having a curved front edge portion as mentioned above, an attachment for reducing the space between the under surface of the cushion plate and the circumferential surface of the cylinder is mounted on the cylinder, as disclosed in Japanese Examined Patent Publication Showa 60 (1985)-30763. This control method, however, is not satisfactory and does not solve the above-mentioned problem but worsens it when the combing machine is driven at a very higher speed.

The above problem is explained hereinafter in more detail. According to the disclosure of the above-mentioned Japanese examined publication, since the principle of the control method is based mainly upon the technical concept that the space between the under surface of the cushion plate and the circumferential surface of the cylinder is reduced during the connecting motion of the combed fringe with the rear end portion of the fleece displaced rearwards by the reverse rotation of the detaching rollers, the attachment used to create the above-mentioned condition is formed by a quarter-circle cylindrical element which extends from the position of the last alignment of the combing needles to the rear end thereof, in the direction of rotation of the combing cylinder. Therefore, during the reverse rotation of the detaching rollers, the space between the circumferential surface of this attachment and the bottom detaching roller is changed, but if the space becomes too small, the quantity of the air flowing into this space from a position above the space, to provide a downward suction force, becomes too small, and thus the strength of the suction air flow passing through this space is weakened. On the other hand, when the combing machine is driven at a higher speed, the speed of displacement of the fleece in the rearward direction by the reverse rotation of the detaching rollers becomes faster than the speed of the downward suction air flow, and accordingly, the back edge portion of the fleece can not be displaced along the circumferential surface of the bottom detaching roller, and thus this back edge portion of the fleece is deformed, i.e., swollen. In this swollen condition, the rear tip portion of this fleece takes a particular curved shape, and therefore, the rear end portion of the fleece in such a deformed condition collides with the front edge portion of the above-mentioned fringe which is being displaced forward, and thus the front ends of individual fibers of the fringe are curved and a proper overlapping of the rear end portion of the fleece and the front end portion of the combed fringe cannot be carried out.

The application of the above-mentioned method of solving the above mentioned problem of the conventional combing machine is restricted, since the speed at which the combing machine is driven cannot be increased.

Although another embodiment of the above prior art is disclosed in FIG. 7, it does not solve the problem discussed in the previous paragraph. Namely, in this embodiment, a space reducing member is mounted on a balance segment having a radius 10 to 15 mm smaller than the radius of the needle segment. No other element covers the balance segment in an angular space between the rear end of the needle segment and this space reducing member, and consequently, when the angular space of the combing cylinder faces the detaching roller, the downward suction air stream passing through the space between the detaching roller and the angular portion of the combing cylinder cannot be reduced, and therefore, the forward end portion of the combed fringe is turned downward by the above-mentioned downward suction air stream. Accordingly, when the combing cylinder is driven at a speed as high as 250 r.p.m., the overlap connection between the rear end portion of the fleece, which is displaced rearwards by the reverse driving of the detaching roller, with the front end portion of the fringe becomes impossible.

SUMMARY OF THE INVENTION

The purpose of the present invention is to solve the above-mentioned problem. Therefore, in the combing cylinder according to the present invention, there is provided a fringe control member having a chevron shaped cross section, which is characterized by a downward sloping surface at the front side thereof in the direction of rotation of the combing cylinder, is rigidly mounted on the combing cylinder at a position behind the rear end of the needle segment, with regard to the direction of rotation of the combing cylinder, in a manner such that, when the direction in which the detaching rollers are driven is changed from a reverse drive to a normal drive, an upper surface of the fringe control member substantially can face the bottom detaching roller. The radius of the front end portion of the above-mentioned sloped surface is made smaller than the radius of the needle segment, to create a recessed portion at a position adjacent to and following the last alignment of the combing needles, with regard to the direction of rotation thereof, to satisfy a timing such that, when the rear end portion of the fleece is displaced downstream by the reverse rotation of the detaching rollers to a space between the detaching rollers and the combing cylinder, the above-mentioned recessed portion faces the bottom detaching roller. Therefore, when the rear end portion of the fleece is displaced downstream by the reverse rotation of the detaching rollers, this rear end portion is pushed downward by a top line surface of the fringe control member, and is moved further downward by a suction air stream passing through the space between the bottom detaching roller and the recessed portion of the fringe control member.

Due to this construction of the fringe control member, during the period when the rear end portion of the fleece is introduced by the reverse rotation of the detaching rollers into the space between the bottom detaching roller and the combing cylinder, the recessed portion of the cylinder faces the detaching roller, and accordingly, the top line surface of the fringe control member also faces the bottom surface of the cushion plate. Further, during a period, after the nipper device has released its grip to a time at which the rotation of the detaching roller is changed to a normal drive, the top line surface of the fringe control member is displaced to a position immediately below the combed fringe. Therefore, during the period that the recessed portion of the combing cylinder faces the bottom detaching roller, since the downward suction air stream affects the area adjacent to the detaching rollers, the fleece, which is displaced rearwards, is introduced downward along the circumferential surface of the bottom detaching roller, a possible creation of hooked individual fibers and an irregular arrangement of fibers can be effectively prevented. Further, the combed fringe is displaced forwards and positioned on the top line surface of the fringe control member, and after the fringe leaves the fringe control member, the front end position of the fringe is blown upwards by the centrifugal air stream due to the driving motion of the fringe control member. Accordingly, since the front end portion of the fringe is overlapped with the rear end portion of the fleece, in a required condition, an irregular arrangement of individual fibers can be effectively prevented.

DESCRIPTION OF THE PREFERRED EMBODIMENT

Figure 1:
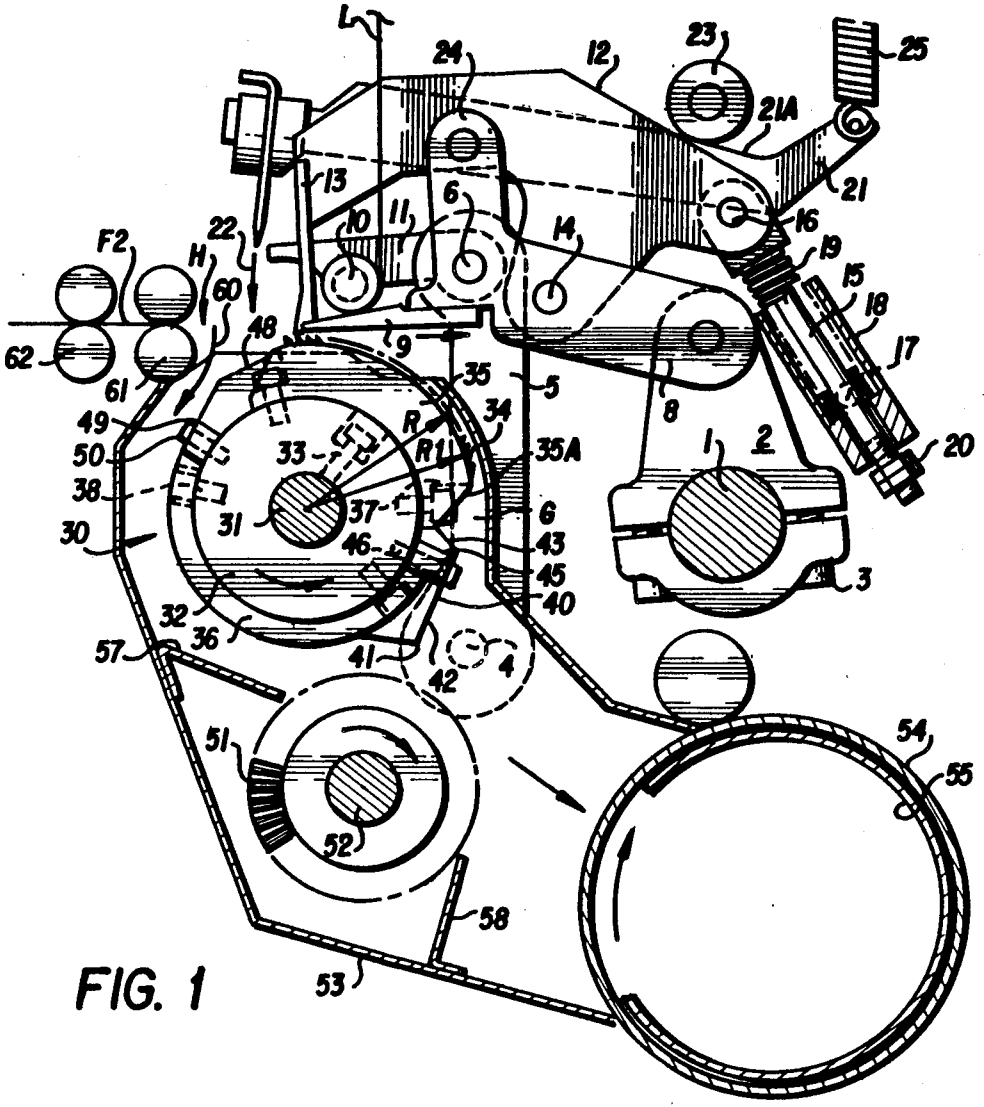
FIG. 1 is a side sectional view of an embodiment of a combing machine utilizing a combing cylinder according to the present invention.

An embodiment of the present invention will be hereinafter explained with reference to the attached FIG. 1. Before explaining the combing cylinder according to the present invention, the general construction and function of the combing machine is briefly described.

In a combing machine, a pair of nipper arms 2 are rigidly mounted on a common nipper shaft 1 mounted on a machine frame and able to rotate in reciprocal directions, for each combing unit. A pair of locker arms 5, which correspond to the nipper arm 2, are disposed at the machine frame and turnably mounted on an nipper branch shaft 4 secured to the machine frame. A four link mechanism is formed by the locker arm 5, a nipper body shaft 6 disposed at an upper end portion of the nipper arm 2, and a driving pin 7 disposed at an upper end portion of the nipper arm 2 and connected with a nipper body 8 so that the nipper body 8 can be displaced forward and backward by the reciprocal rotation of the nipper shaft 1. A cushion plate 9 is secured to the nipper body 8, and a roller pressing arm 11 rotatably supporting a feed roller 10 is turnably mounted on a nipper body branch shaft 6, so that the feed roller 10 is urged toward the cushion plate 9 by a torsion bar (not shown). A knife arm 12 having a nipper knife 13 arranged at the forward end portion thereof, is turnably mounted on the nipper body 8 by a shaft 14, and a knife pressing rod 15 is connected to the rear end of the knife arm 12 by a pin 16. The nipper knife 13 is urged toward the cushion plate 9 by the resilient force of a helical spring 19, which is mounted on the pressing rod 15 inside a spring-cylinder 18 mounted on the machine frame, by a supporting shaft 17. Accordingly, during the forward displacement of the nipper device, when a lock-nut 20, which is secured to the knife pressing rod 15 by a screw, comes into contact with the spring-cylinder 18, the nipper knife 13 is opened. A top comb arm 21 provided with a top comb 22 at the tip end thereof is journaled to an upper end portion of the nipper body 8 by a shaft 24, and a cam surface 21A is urged against a cam follower 23, which is loosely engaged with a pin secured to the machine frame, so that the top comb 22 can be displaced upward and downward in accordance with the forward and rearward displacing motion of the nipper body 8.

Next, the construction of the combing cylinder according to the present invention is explained. A cylindrical boss 32 is rigidly fixed to a common cylinder shaft 31, which is rotatably supported by a machine frame for all combing units, by a bolt 33, and a needle segment 35 forming a part of the cylindrical body, wherein numerous combing needles 34 are implanted, and a balance segment 36 forming a part of the cylindrical body, the radius thereof being smaller than the radius $R_1$ of the needle segment 35, are detachably secured to the cylinder boss 32 by four fastening bolts 37, 38 in such a manner that the entire peripheral surface of the cylindrical boss 32 is substantially fully covered by the needle segment 35 and the balance segment 36. A fringe control member 40 having a chevron shaped cross-section, which is a main constitutional element of the present invention, is rigidly mounted on the cylinder boss 32 by a screw 46, via a cylindrical washer 45, at an angular position downstream of the needle segment 35 with respect to the direction of rotation of the combing cylinder 30, in such a manner that the rear end portion of the needle segment 35 and a part of the forward end portion of the balance segment 36 are covered. In this embodiment, the fringe control member 40 is formed by a steel plate having a smooth surface, and the distance between the top line surface 41 thereof and the axial center of the cylinder shaft 31 (hereinafter referred to as a height of the top line surface 41 of the fringe control member 40) is almost identical to the radius R of the peripheral tracing cylindrical surface defined by the tip points of the combing needles 34 of the needle segment 35. The forwardly inclined surface 42, which is defined by an angle Θ between the surface 42 and an imaginary tangent plane to an imaginary tracing cylinder defined by the top surface line 41 of the fringe control member 40, is formed in the member 40. This angle $\theta$ is hereinafter referred to as an inclined angle (see FIG. 4). The forward end surface portion 43 of the surface 42 of the member 40 is further steeply inclined toward the axial center of the cylinder 30, and the radius of the forward end surface 43 at the forward terminal thereof becomes smaller than the radius R of the needle segment 35. At a position immediately rearward of the last alignment of the combing needle 34 of the needle segment 35, the needle segment 35 is provided with a steep surface 35A rearwardly inclined toward the cylinder boss 32, and accordingly, a sharp recessed portion G is formed at a position following the last alignment of the combing needles 34 on the needle segment 35 in cooperation with the above-mentioned inclined surface 43 of the fringe control member 40. A cover 48 is secured to the cylinder boss 32 by screws 50, via cylindrical washers 49, to cover the space and form a partial cylindrical surface having a common axial center with the cylinder boss 32, between the forward end of the needle segment 35 and the rearward end of the balance segment 36.

A rotary brush 51 is mounted on the combing machine and operates commonly for all combing units, wherein the combing cylinders 30 rotate at a very high rotational speed, i.e., higher than 250 r.p.m. The rotary brush 51 is secured to a brush shaft 52, and the tip portion of the brush 51 can come into frictional contact with the combing needles 34 so that short fibers remaining on the needles 34 are removed. A suction box 53 is disposed in the combing machine in such a manner that the cylinder 30 and the rotary brush 51 are surrounded by the box 53, and a suction roller 54 provided with numerous suction apertures is rotatably disposed at a position near the bottom open end portion of the box 53. The suction roller 54 is provided with a damper drum 55 disposed inside thereof, as shown in FIG. 1, and the damper drum 55 is connected to a suction source (not shown). A pair of plates 57, 58, which are utilized to control the flow of the suction air stream 60 from the upper portion to the lower portion in the suction box 53, is rigidly secured to the inside surface of the suction box 53 by welding. This downward suction air stream 60 between the front side of the suction box cover and the cylinder 30 flows in a direction identical to the direction of rotation of the combing cylinder 30, and the downward suction air stream 60 between the back side of the suction box cover and the cylinder 30 flows in a direction which is the reverse of the direction of rotation of the cylinder 30. Namely, in the downward suction air stream 60, the air located at a position H adjacent to the detaching rollers 61 is sucked into the space between the detaching rollers 61 and the combing cylinder 30. Two pairs of detaching rollers 61, 62 alternately repeat a combination of a normal rotation and a reverse rotation, to displace a fleece forward and rearward. The timing of such a normal and reverse rotation is adjusted to match the required spinning conditions, based upon the type of yarns. According to the present invention, this timing preferably satisfies the following condition, i.e., when the direction of rotation of the detaching rollers 61, 62 is changed to start the normal rotation (See FIG. 5), the tip line surface 41 of the fringe control member 40 is positioned to almost face the bottom detaching roller 61.

Next, the working function of the combing machine according to the present invention is explained in detail with reference to FIG. 1 to FIG. 5. A lap L, which is rewound as a fiber belt by a lap supply device (not shown), is fed into the above-mentioned combing machine by the positive drive feed roller 10 and is gripped by the nipper knife 13 and the cushion plate 9, which intermittently open and close to relax and impose a grip, respectively. The gripped lap L is combed by the combing needles 34 of the combing segment 35 of the combing cylinder 30, which rotates in the counterclockwise direction in the drawings as indicated by an arrow. The relative condition of the gripped lap L and the machine elements of the combing cylinder 30 is shown in FIG. 1, which shows the start of the combing action. The front end portion of combed fringe F1 is connected to a rear end portion of a fleece F2 displaced rearward (to the right in the drawings) by the reverse rotation of the detaching rollers 61, 62 while both are overlapped, and thereafter, the connected fleece is displaced forward by the normal rotation of these detaching rollers 61, 62, and then the continuous fleece F2 is condensed to a sliver form. A number of such slivers from the respective combing units are accumulated in a doubled condition, and then that material is subjected to a drafting operation. The drafted material is formed as a combed sliver and contained in a container (not shown).

Figure 2:
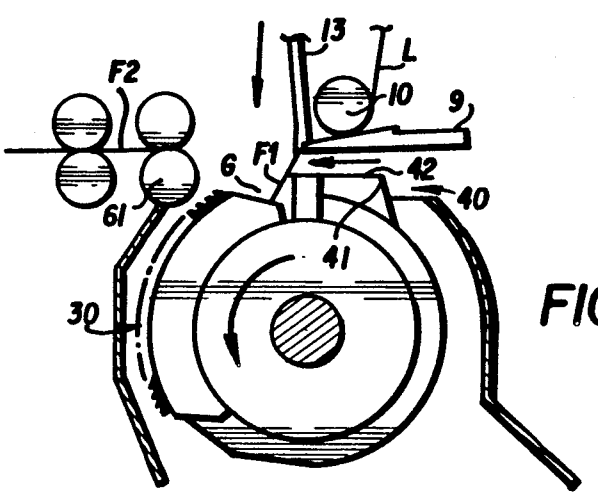
Figure 3:
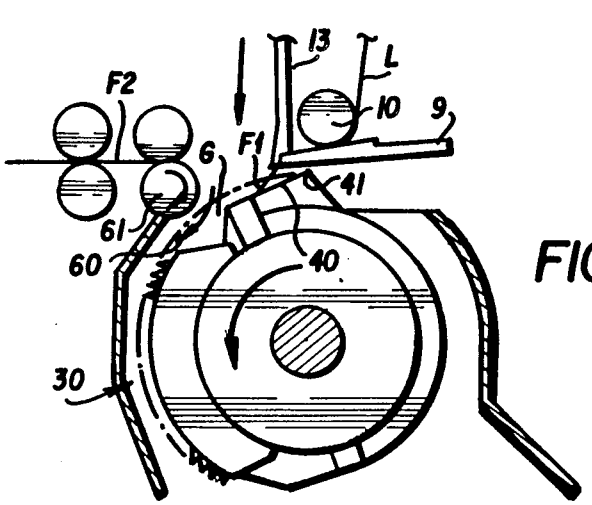

In FIG. 2, the relative action and position of main machine elements of the combing machine is shown at a time when the combing action by the combing needles 34 of the combing cylinder 30 is carried out such that the last alignment of the combing needles 34 leaves them facing the bottom detaching roller 61, and the detaching rollers 61, 62 start to reverse their rotation. At this timing, the forwardly inclined surface 42 of the fringe control member 40 is facing and in parallel with the bottom surface of the cushion plate 9. In this condition, the space between the inclined surface 42 and the bottom surface of the cushion plate 9 is smaller than the space between the outer peripheral surface of the balance segment 36 and the bottom surface of the cushion plate 9. Nevertheless, since the above-mentioned space between the forwardly inclined surface 42 and the bottom surface of the cushion plate 9 is large enough to create a weak air stream passing through this space in the direction opposite to the detaching rollers 61, 62, with respect to the combing cylinder 30, the weak air stream acts on the combed fringe F1 so that the combed fringe F1 assumes a hanging posture while in slidable contact with the above-mentioned forwardly inclined surface 42 of the fringe control member 40. Upon further rotation of the cylinder 30, the space between the top line surface 41 of the fringe control member 40 and the bottom surface of the cushion plate 9 is gradually reduced, and the recessed portion G formed behind the last alignment of combing needles 34 on the needle segment 35 of the combing cylinder 30 gradually comes to face the bottom detaching roller 61. During a period in which the rear end portion of the fleece F2, which is displaced rearward by the reverse rotation of the detaching rollers 62, 63, is passing through a space between the bottom detaching roller 61 and the combing cylinder 30, the above-mentioned recessed portion G is facing the bottom detaching roller 61 as shown in FIG. 3, the downward suction air stream of the suction box 53 is applied to the area of the detaching roller 61, and accordingly, the rear end portion of the fleece F2 assumes a posture such that it is directed downwards along the peripheral surface of the bottom detaching roller 61.

On the other hand, the fringe F1 is in the condition shown in FIG. 2, since the peripheral speed of the rotating cylinder 30 is faster than the forward displacing speed of the nipper device. The fringe F1 gripped by the nipper device is in slidable contact with the top line surface 41 of the fringe control member 40 and in an upward free condition, so that the fringe F1 is straightened, and when the nipper knife 13 of the nipper device starts to move away from the cushion plate 9, the top line surface 41 of the fringe control device 40 faces the bottom surface of the cushion plate 9 as shown in FIG. 3. A further turning of the cylinder 30 through the rotation axis thereof, and a further enlarging of the opening between the nipper knife 13 and the cushion plage 9, causes the fringe F1 connected to the lap L to be further gradually displaced forward to the most forward position of the nipper device by the rotation of the feed roller 10 in contact with the upper surface of the cushion plate 9, for a predetermined distance, and the hanging posture of the fringe F1 is changed to an upward facing posture due to the elastic recover force thereof, so that the forward end portion of the fringe F1 moves away from the top line surface 41 of the fringe control member 40. Under the above condition, the top line surface 41 of the fringe control member 40 passes below the bottom surface of the fringe F1. Since the forward inclined surface 42 is formed with the inclined angle $\theta$, a weak accompanying air stream toward the centrifugal direction of the combing cylinder 30, which is created by the high speed rotation of the cylinder 30, acts on the above-mentioned fringe F1 from the downward side thereof so that the fringe F1 is blown up by the action of this weak air stream, and accordingly, the physical recovery tendency of the component individual fibers of the fringe F1, which deform the fringe posture to a horizontal condition, is accelerated. Accordingly, when the forward end portion of the fringe F1 is just approaching the perpherical surface of the bottom detaching roller 61, the posture of the fringe F1 has become almost horizontal. Also, the fiber density of the forward end portion of the fringe F1 has become thin, and immediately before the timing at which the forward end portion F1 comes into contact with the bottom detaching roller 61, the forward end portion of the fringe F1 is moved slightly upward from the horizontal condition by the action of the above-mentioned centrifugal force, as shown in FIG. 4.

Figure 4:
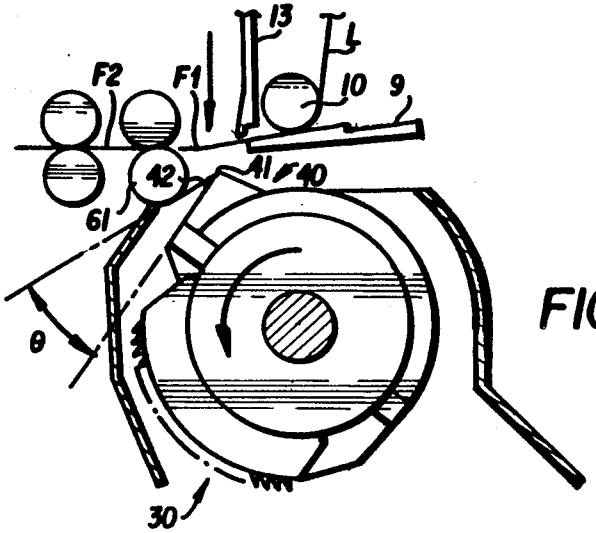
FIGS. 2 to 5 are sectional views of the main part of the combing machine shown in FIG. 1, wherein the working conditions of the fringe control member are shown.
Figure 5:
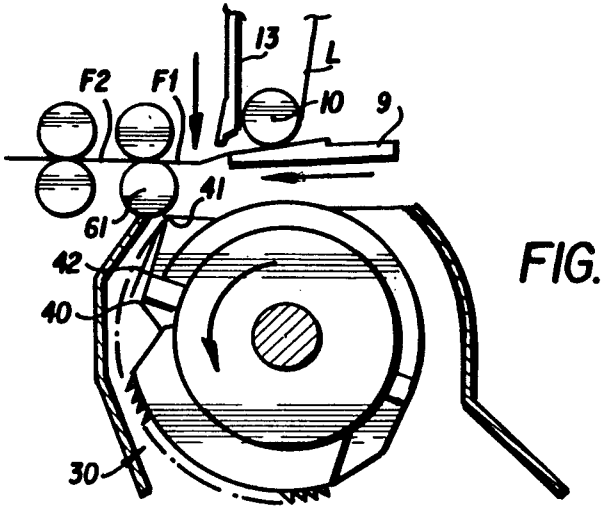

After the detaching rollers 61, 62 further rotate in a reverse direction, and when the rotation thereof start to change to the normal rotation as shown in FIG. 5, the top line surface 41 of the fringe control member 40 comes to a position almost facing the bottom detaching roller 61, and the space between the top line surface 41 and the bottom detaching roller 61 is changed from the condition shown in FIG. 4 to the condition shown in FIG. 5. Namely, the above-mentioned distance is minimized when the detaching rollers 61, 62 start to rotate in the normal direction. Accordingly, the centrifugal air stream created by the rotation of the combing cylinder 30 has a slight effect on the fringe F1, and thus the forward end portion of the fringe F1 is connected to the upper surface of the rearward end portion of the fleece F2 in a correct overlapped condition. As mentioned above, until this correct connection of the fringe F1 with the fleece F2 after opening the nipper knife 13 of the nipper device, the fringe control member 40 is displaced to a position below the fringe F1 so that the top line surface 41 of the fringe control member 40 comes into sliding contact with the bottom surface of the combed fringe F1, whereby the fibers of the fringe F1 are straightened. When the fringe F1 has moved away from the slidable contact with the top line surface 41 of the fringe control member 40, the fringe F1 is blown up by the centrifugal force created by the rotational displacement of the member 40 about the axis of the cylinder 30, so that the posture of the fringe F1 becomes almost horizontal, and accordingly, the forward end portion of the fringe F1 can be connected to the rearward end portion of the fleece F2, which has been displaced rearwards, in an overlapped condition. A result of this mode of connection of the rearward end portion of the fleece F2 with the forward end portion of the fringe F1 is that the creation of front, back hooked fibers, and an irregular fiber arrangement, can be completely prevented, and therefore, a high speed driving of the combing machine can be effectively performed. The connected fleece F2 is displaced forward by the normal rotation of the detaching rollers 61, 62. When the forward end portion of the fringe F1 is gripped by the detaching roller 61 and the fringe F1 is then placed under tension, the top comb 22 is inserted into the fringe F1 so that the rear end portion of the fringe F1 is combed thereby while the nipper device is displaced rearwards. During the above-mentioned action of the top comb 22, the fringe F1 is separated from the fleece gripped by the detaching rollers 61, and the next combing action for the fringe F1 gripped by the nipper knife 13 and the cushion plate 9 is then carried out as shown in FIG. 1.

Next, practical data which support the characteristic feature of the combing cylinder 30 according to the present invention, obtained by utilizing a combing machine (Trade Mark: K2 comber) produced by Howa Kogyo Co., Ltd., is disclosed.

Figure 6:
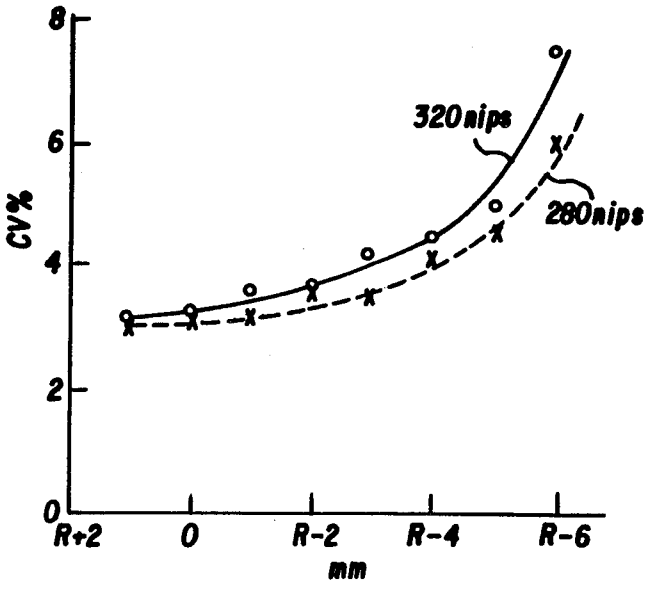
FIG. 6 is a diagram indicating a variation of uniformity of a combed sliver produced by a combing machine utilizing the fringe control members having different radii of the top line surface thereof.

In the combing cylinder 30 utilized for this combing machine, the inclined angle $\theta$ of the inclined surface 42 of the fringe control device 40 is made 30°, and the device 40 has the shape as described above. In this test, several models having different radii of the top line surface 41 of the fringe control members 40 were prepared. Each of the above-mentioned fringe control member 40 was mounted on the combing cylinder, separately, and combed slivers were produced. Thereafter, the evenness with regard to the variation of thickness CV % was measured for all of the combed slivers produced by these tests. The variation of thickness of the sliver was measured by measuring variations of the weight of an 8 mm sliver (unit length). The results of the tests are diagrammatically shown in FIG. 6. In this test, the operating condition of the combing machine was as shown in the following table.

| Operating condition | |
|---|---|
| Weight of supplied lap/unit length | 800 grain/yard (57 grams/meter) |
| Spinning count of combed sliver | 350 grain/6 yd. (64 grams/meter) |
| Draft of drafting device of combing machine | 6 |
| Rotational speed of combing cylinder | 280 r.p.m. and 320 r.p.m. |

In the conventional combing machine, when the speed of rotation of the combing cylinder exceeds 230 r.p.m., the uniformity of the combed sliver CV % becomes very poor, and a combed sliver having such a poor quality cannot be used in practice. When the speed of rotation of the combing cylinder exceeds 250 r.p.m., the connection of the rear end portion of the fleece F2 with the fringe F1 becomes practically impossible, as described above, but according to the above-mentioned tests, it was confirmed that the operation of the combing machine utilizing the combing cylinder according to the present invention can be practically carried out to produce a combed sliver having a high quality with a higher CV % value, even under spinning conditions wherein the combing cylinder is rotated at a speed 1.4 times higher than the speed of rotation of the conventional combing machine. According to these tests, it was confirmed that the preferable condition is such that the radius of the tip line surface 41 of the fringe control member 40 is identical to the radius R of the imaginary peripheral surface defined by the tip point of each combing needles 34. Nevertheless, as clear from the diagrams shown in FIG. 6, even if the radius of the above-mentioned peripheral surface was changed within a range of [R and (R−5)] mm, it was confirmed that a combed sliver having a practically useful evenness can be produced. Where the radius of the tip line surface 41 of the fringe control member 40 is identical to the radius R of the above-mentioned peripheral surface, the tip line surface 41 may come into contact with the rotation brush 51, but since the forward inclined surface 42 of the fringe control member 40 is smooth, the rotation brush 51 will not be damaged. According to the data of FIG. 6 regarding the tests under a high speed rotation of the combing cylinder 30 at 280 r.p.m. and 320 r.p.m., it is clearly possible to drive the combing cylinder at speeds faster than used in these tests, because the superior CV % data shown in FIG. 6 was obtained.

Figure 8:
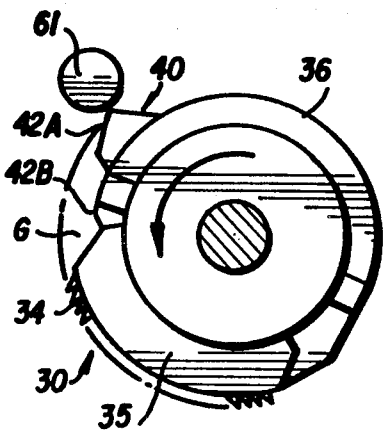
FIGS. 7, 8, 9 and 10 are sectional views of embodiments of the present inventions.
Figure 10:
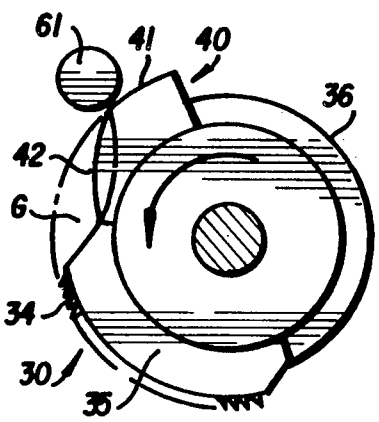
Figure 7:
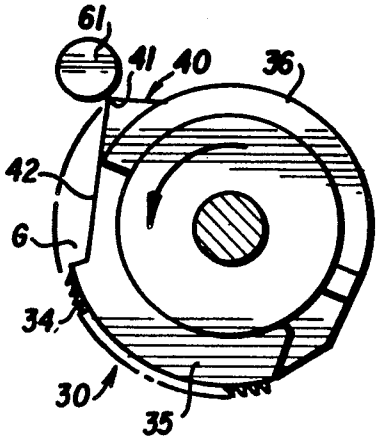
Figure 9:
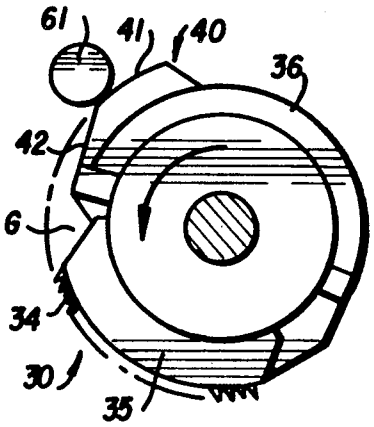

The embodiments shown in FIGS. 7 to 10 disclose modifications of the fringe control member 40 in which the radius of the tip line surface 41 is identical to the radius R of the above-mentioned imaginary peripheral surface of the tip points of the combing needles 34, under the operative condition in which the detaching rollers 61 is starting a normal drive. In the embodiment shown in FIG. 7, the inclined angle $\theta$ of the forward side inclined surface 42 is larger than that of the first embodiment, whereby the steep inclined surface formed at the forward end portion of the fringe control member 40 is eliminated. On the other hand, the embodiment shown in FIG. 8 is provided with an inclined surface divided into two separate surfaces 42A and 42B. In the embodiment shown in FIGS. 9 and 10, the tip line surface 41 is modified to be a partially cylindrical surface, so that even at the same timing as that when the fringe F1 moves away from the fringe control member 40 shown in FIG. 4, the space between the bottom surface of the cushion plate 9 and the fringe control member 40 can be kept small. The embodiment shown in FIG. 10 is provided with the fringe control member 40 made of an aluminum alloy, wherein the forward inclined surface 42 has a slightly projecting part-cylindrical surface. It is also possible for the forward inclined surface 42 to have a slightly concaved surface, as indicated by an imaginary line in FIG. 10.

As described in detail above with reference to the embodiments shown in the attached drawings, in the combing cylinder according to the present invention, until the rearward end portion of the fleece F2, which was displaced rearward by the reverse rotation of the detaching rollers 61, 62, passes through the space between the bottom detaching roller 61 and the peripheral surface of the combing cylinder 30, the downward suction air stream can be applied to the rearward and portion of the fleece F2, and therefore, even if the combing machine is driven at a high speed, the creation of fiber-hooks and a disordered fiber arrangement can be effectively prevented. Further, until the combed fringe F1 is transferred to the detaching rollers 61 after having moved away from the gripper of the nipper device, since the centrifugal air stream created by the rotation of the fringe control member 40 about the rotational axis of the combing cylinder 30 acts directly on the fringe F1, the connection of the forward end portion of the fringe F1 to the rearward end portion of the fleece F2 in an overlapped condition can be smoothly and effectively carried out while preventing a possible creation of hooked fibers and a disordered fiber arrangement. Accordingly, a high speed driving of the combing machine, which speed can not be practically applied to the conventional combing machine can be applied to operate the improved combing machine according to the present invention, while maintaining the high quality of the combed sliver wherein the presence of hooked fibers and a disordered fiber arrangement are strictly limited. On the other hand, if the combing cylinder utilizing the fringe control member 40 according to the present invention is operated at a speed similar to that of the conventional combing machine, it was confirmed that the uniformity (CV %) of the combed sliver is increased by 20%, because the parallel condition of the fiber arrangement in the combed sliver is remarkably improved.

We claim:

1. In a combing machine for producing a combed silver from a supplied lap and provided with two pairs of top and bottom detaching rollers which are capable of alternately rotating in a normal direction and in a reverse direction, and a combing cylinder rotating in one rotational direction and provided with a cylindrical boss, a needle segment wherein numerous combing needles are planted, and a balance segment having a smaller radius than said needle segment, said needle segment and said balance segment being detachably secured to the peripheral surface of said cylindrical boss, the improvement comprising a fringe control member having a chevron shaped cross section as viewed on a plane perpendicular to the axis of rotation of said combing cylinder, said fringe control member having on its surface closest to said needle segment a forwardly inclined surface sloped towards said cylindrical boss, said fringe control member being secured to said cylindrical boss at a position angularly downstream of said needle segment with respect to the direction of rotation of said combing cylinder whereby a tip line surface of said fringe control member closely faces an upstream side bottom roller of said detaching rollers at the time when said detaching rollers, start to change rotational direction thereof from said reverse rotation to said normal rotation, wherein a radial protrusion of the forward end of said fringe control member is smaller than a radial protrusion of a peripheral surface of said needle segment so as to form a recessed portion adjacent to and behind the last alignment of combing needles of said needles segment.

2. An improved combing cylinder according to claim 1, wherein a radius of said tip line surface of said fringe control member is between R+1 mm and R−5 mm, where R indicates a radius of a peripheral surface of a tip end of said combing needles planted in said needle segment.

3. An improved combing cylinder according to claim 1, wherein a radius of said tip line surface of said fringe control member is identical to the radius of said peripheral surface of a tip end of said combing needles planted in said needle segment.

4. An improved combing cylinder according to claim 3, wherein said forwardly inclined surface of said fringe control member is formed by a plane.

5. An improved combing cylinder according to claim 3, wherein said forwardly inclined surface of said fringe control member is divided into a first slope and a second slope, said second slope being steeper than said first slope.

6. An improved combing cylinder according to claim 4, wherein said tip line surface is changed to a part of a cylindrical surface coaxial to said balance segment.

7. An improved combing cylinder according to claim 3, wherein said inclined surface is a concave surface.

8. An improved combing cylinder according to claim 3, wherein said inclined surface is a convex surface.

* * * * *